United States Patent [19]

Dennis

[11] Patent Number: 4,560,226

[45] Date of Patent: Dec. 24, 1985

[54] ELECTRICAL CONNECTOR MEMBER AND CONTACTOR UNIT

[75] Inventor: Alan J. Dennis, Nottingham, United Kingdom

[73] Assignee: TRW Inc., Redondo Beach, Calif.

[21] Appl. No.: 465,866

[22] PCT Filed: Jun. 29, 1982

[86] PCT No.: PCT/GB82/00191

§ 371 Date: Feb. 7, 1983

§ 102(e) Date: Feb. 7, 1983

[30] Foreign Application Priority Data

Jun. 30, 1981 [GB] United Kingdom ..... 8120108

[51] Int. Cl.[4] ..... H01R 4/24; H01R 11/20; H01R 13/502

[52] U.S. Cl. ..... 339/99 R; 339/17 F; 339/176 MF

[58] Field of Search ..... 339/176 MF, 17 F, 99 R, 339/136 R, 136 M, 143 R

[56] References Cited

U.S. PATENT DOCUMENTS

| | | | |
|---|---|---|---|
| 3,820,058 | 6/1974 | Friend | 339/176 MF X |
| 3,858,159 | 12/1974 | Worth | 339/99 R |
| 3,879,099 | 4/1975 | Shaffer | 339/176 MF X |
| 4,190,952 | 3/1980 | Thomas et al. | 29/749 X |
| 4,253,722 | 3/1981 | Fox, Jr. | 339/99 R |
| 4,381,132 | 4/1983 | Tournier | 339/176 MF X |
| 4,418,977 | 12/1983 | O'Shea, Jr. | 339/99 R |
| 4,428,637 | 1/1984 | Worth | 339/99 R |
| 4,460,228 | 7/1984 | Lane et al. | 339/99 R |
| 4,464,002 | 8/1984 | Suzuki et al. | 339/99 R X |
| 4,512,621 | 4/1985 | Bethurum | 339/99 R |

FOREIGN PATENT DOCUMENTS

| | | | |
|---|---|---|---|
| 2738869 | 3/1979 | Fed. Rep. of Germany | 339/99 R |
| 1506828 | 4/1978 | United Kingdom | 339/99 R |
| 2033676 | 5/1980 | United Kingdom . | |
| 2083295 | 3/1982 | United Kingdom | 339/17 F |

OTHER PUBLICATIONS

Brian F. Whittaker, "A Mass-Termination, Filtered Connector for RS-232-C Circuits", Thirteenth Annual Connector Symposium Proceedings, pp. 197-204, 10/1980.

*Primary Examiner*—Joseph H. Mcglynn
*Assistant Examiner*—Steven C. Bishop
*Attorney, Agent, or Firm*—Donald R. Nyhagen

[57] ABSTRACT

A subminiature multi-pin/socket connector member (10) comprising an elongate housing and at east two rows of contactor unit (11) mounted in the housing, each contactor unit including a contactor portion (12) extending from a front face of the housing and a termination (13) extending from a rear face of the housing, the contactor units and terminations being, each collectively, arranged in staggered formation, wherein the pitch of the terminations differs from the pitch of the contactor units.

Also a contactor unit (11) e.g. for a subminiature multi-pin/socket connector, the unit being formed of e.g. metal strip material and comprising a contactor portion (2) e.g. of pin or socket form, a termination (13) and a torsionally flexible bridge portion (15) interconnecting the contacting portion and the termination.

17 Claims, 6 Drawing Figures

ELECTRICAL CONNECTOR MEMBER AND CONTACTOR UNIT

Figure 1:
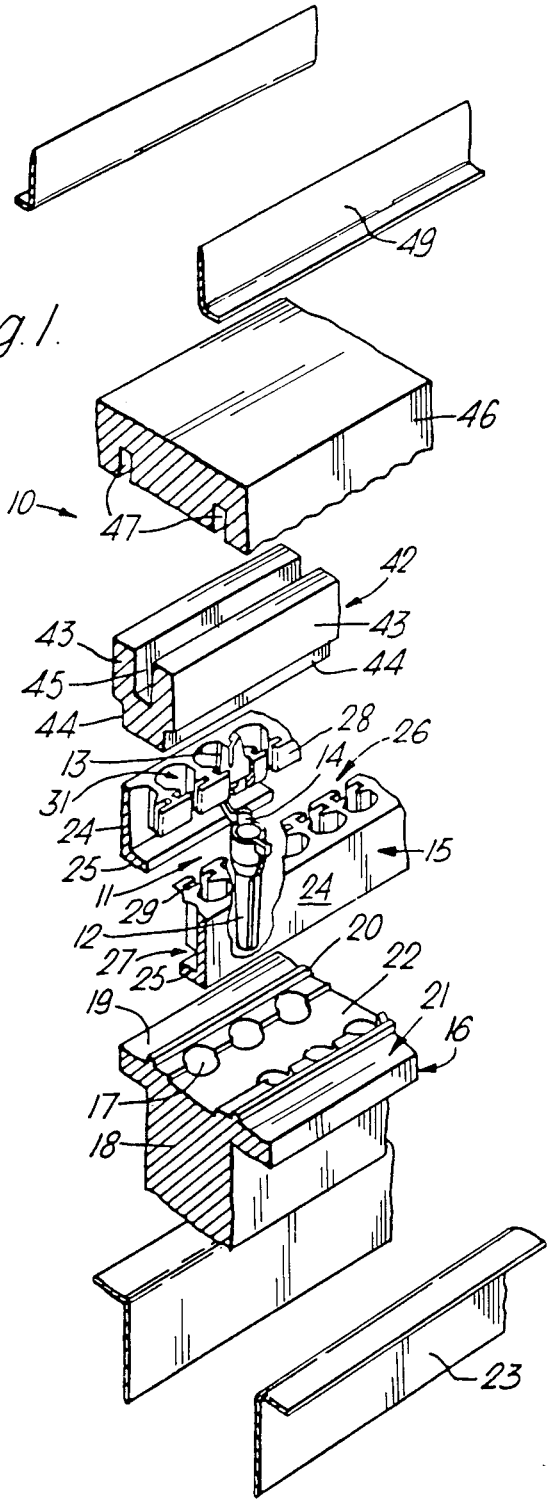

The present invention relates to electrical connectors, especially subminiature multi-pin/socket connectors. Known connectors of this type have complementary plug members and socket members, the plug members being formed with pins and the socket members with individual sockets to receive the pins. Where it is not desired to distinguish between pins and sockets these are referred to as contactors. Each contactor normally forms part of an integral contactor unit including a contactor portion, which may be a pin or a socket, and a termination, which is adapted to make contact with an electrical lead, commonly an individual conductor of a ribbon cable.

Known multi-pin/socket connector members comprise an elongate housing and at least two rows of contactor units mounted in the housing, each contactor unit including a contactor portion extending from a front face of the housing and a termination extending from a rear face of the housing. The contactor units and terminations are normally, each collectively, arranged in staggered formation, to facilitate connection to a ribbon cable which extends at right angles to the length dimension of the connector member.

In a common form of connector member the terminations are constituted by flat tabs having a conductor-receiving slot terminating in a notched entrance. This enables a PVC covered conductor to be connected merely by forcing the insulated conductor into the notch, which automatically cuts through the insulation so that the conductor makes contact with each edge of the slot.

In known connectors of the type described, the terminations and contactor portions of each contactor unit are arranged in a line so that in the connector member the pitch of the terminations is equal to the pitch of the contactor units. By "pitch" is meant the distance, as viewed along one side of the connector member, between the individual terminations (or contactor portions) of two parallel rows.

More commonly, connectors of this type have two rows of contactor units, in order to receive one ribbon cable. However, where more than one ribbon cable is used, there may be three or four rows. Thus a very common type of connector member will have thirtyseven contactor units, there being one row of eighteen units and one row of nineteen units.

In connecting a subminiature multi-pin connector member to ribbon cable, a serious problem arises in that different conventions have arisen regarding the pitch of contactor portions as manufactured by connector manufacturers and the pitch between the strands of ribbon cable as manufactured by cable manufacturers. The common convention on the pitch of ribbon cable is 0.050 inches (1.27 mm). This is the distance between the centres of the conductors. In the case of subminiature connectors, the pitch is sometimes given as the distance between pins in a row. In this sense the convention is to use 0.109 inches (2.77 mm), for the pitch. As defined in this specification, the pitch would therefore be 0.0545 inches (1.39 mm).

Although the discrepancy in pitch between the pins and cable appears small, this difference becomes magnified when there are e.g. thirty seven strands of cable to be considered and in practice it means that the cable has to be divided and each strand individually connected. This adds quite considerably to the assembly time of electronic units and also increase the possibility of imperfect connections.

It is known from U.K. Pat. No. 1 506 828 to utilise a contactor unit having a central portion which is bent to a Z form so that the two ends can be axially offset. However this necessitates a contactor unit of undesirable length. Also the length of the contacting portion varies according to position necessitating the manufacture of numerous different sizes.

The present invention is aimed at overcoming the above problems.

According to the invention there is provided a contactor unit for an electrical connector, comprising a contactor portion and a termination, characterised by a torsionally flexible bridge portion interconnecting the contacting portion and the termination.

By "torsionally flexible" it is meant that the two ends of the connector unit can be oppositely rotated about a generally lengthwise axis. Only a small angle of rotation is normally necessary. By means of the invention the contactor units can be made of standard size and of short length.

Each contactor unit may be formed of an integral piece of metal. The flexible bridge portion may be torsionally flexible about an axis parallel to the coupling axis of the contactor member. The bridge portion may be of bowed shape e.g. of V or U shape with the bow extending generally radially from the coupling axis of the contactor member. For convenience of use with ribbon cable, the terminations may each comprise a flat tab having a conductor-receiving slot terminating in a notched entrance. In the preferred form of contactor unit, each tab lies in a plane offset from the coupling axis of the contactor portion.

The invention includes a connector member comprising an elongate housing and at least one row of contactor units as described above mounted in the housing, each contactor unit including a contactor portion at a front face of the housing and a termination at a rear face of the housing, wherein the pitch of the terminations differs from the pitch of the contactor portions.

The invention is also inclusive of a connector consisting of complementary plug and socket members as described above, in which the contacting portions of one member are constituted by pins and those of the other member by sockets. The invention also includes a contactor member as described above connected to an undivided ribbon cable.

While the connector member may have only one row contactor units, the invention is particularly useful in connection with multiple connectors having two or more such rows.

Figure 2:
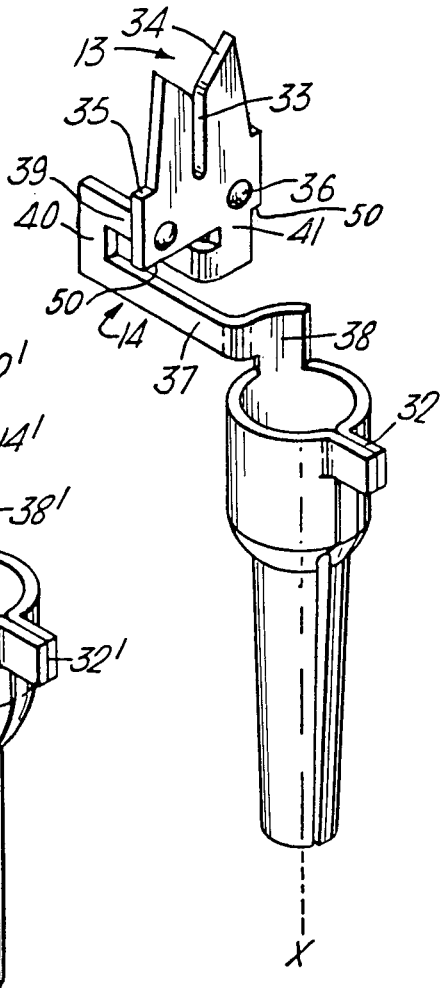
Figure 3:
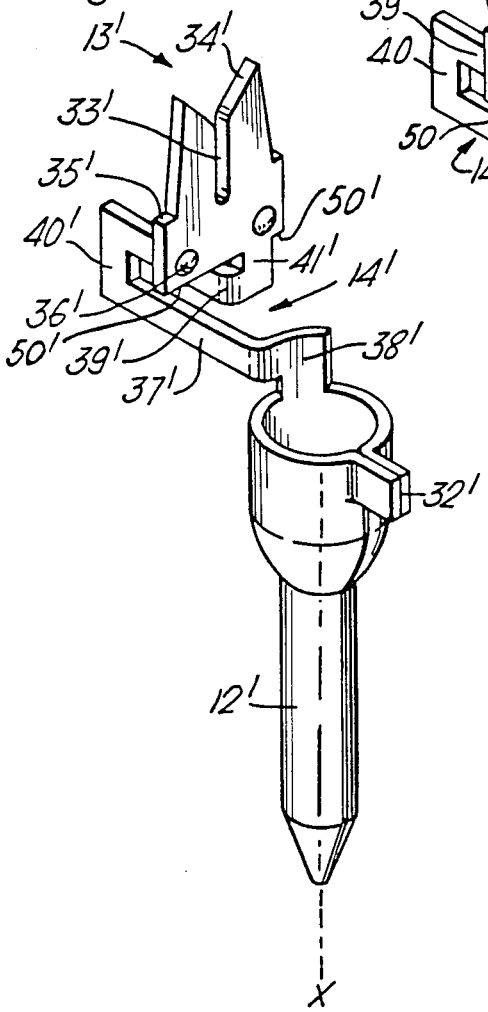
Figure 4:
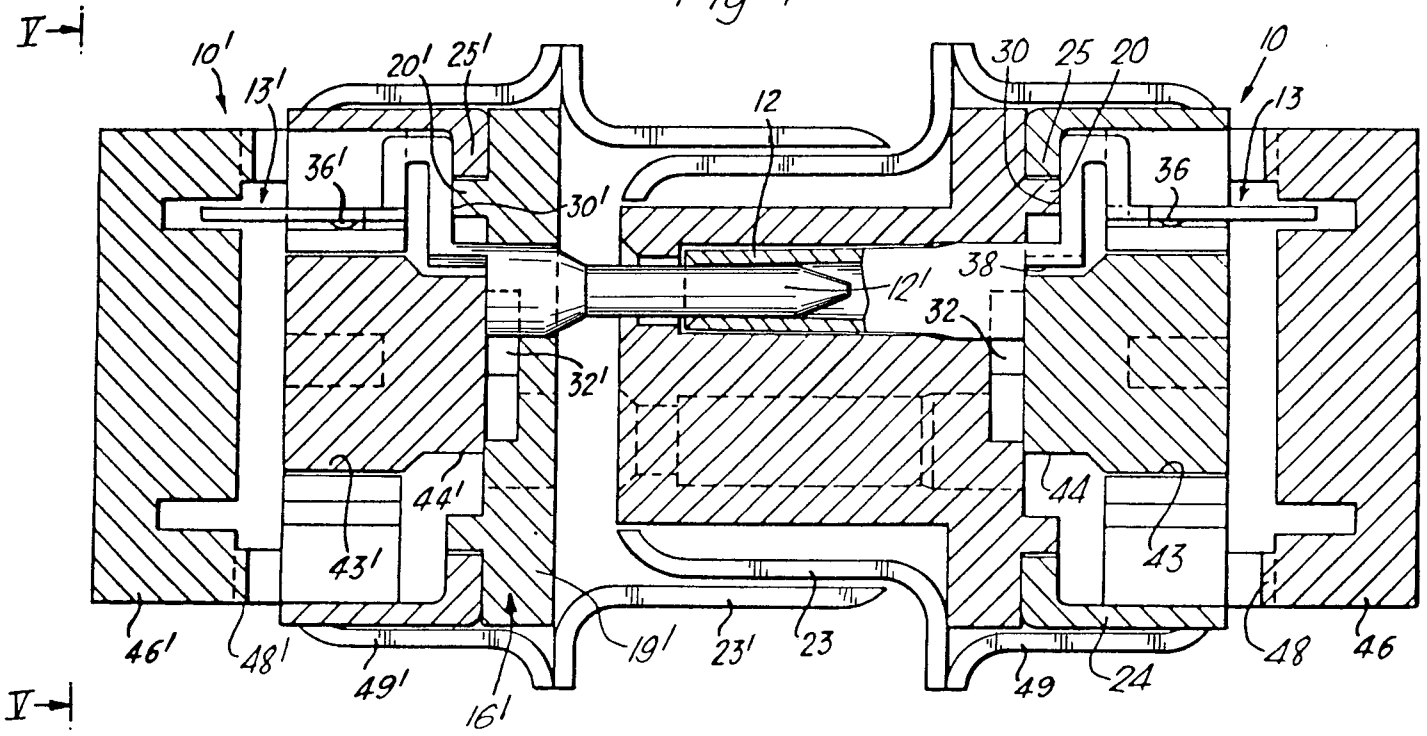
Figure 5:
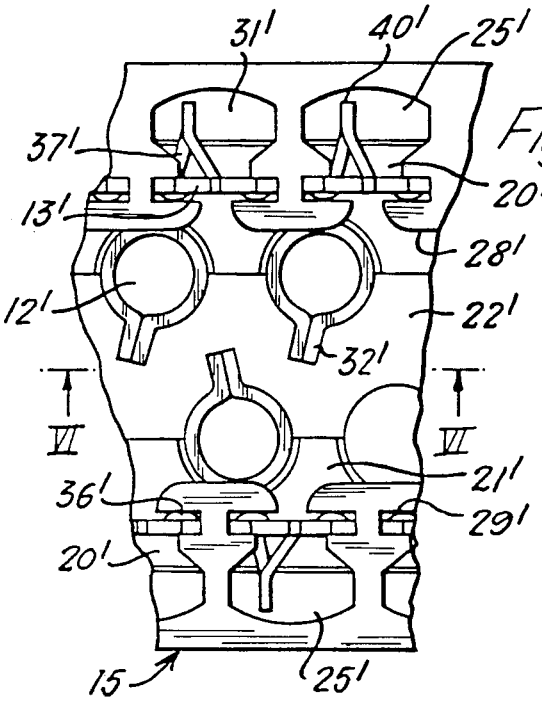
Figure 6:
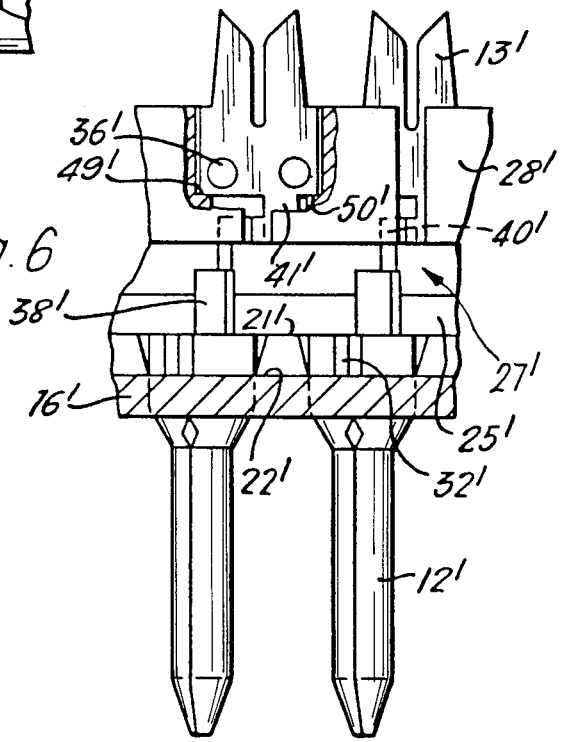

Embodiments of the invention are hereafter described with reference to the accompanying drawings in which:

FIG. 1 is an exploded perspective view of a socket member in accordance with the invention, FIG. 2 is an enlarged perspective view of a socket unit as illustrated in FIG. 1, FIG. 3 is a view similar to FIG. 2 of a complementary pin unit, FIG. 4 is a cross-sectional view of a coupled connector in accordance with the invention, FIG. 5 is a rear plan view of a pin member in accordance with the invention, as viewed along the line V—V of FIG. 4 with cover 46' removed, and FIG. 6 is a longitudinal sectional view corresponding to FIG. 5, as viewed along the line VI—VI of FIG. 5.

In the drawings it will be appreciated that contactor members may be in the form of pin members or socket members which are essentially complementary and for convenience the complementary parts of the socket members will be designated by plain numerals and those of the pin members by primed numerals.

The associated parts of a socket member 10 are shown most clearly in FIG. 1 where only a central portion of an elongate housing is shown, since the number of contactor units along the length of the housing may vary.

A single socket unit 11 is shown, having a contacting portion 12 defined as a socket portion, a termination 13 in the form of a notched and slotted tab and a flexible bridge portion 14 interconnecting the contacting portion and the termination. The socket unit is housed essentially between a rear moulding 15 and a front moulding 16. The socket portions 12 are firmly located within bores 17 in the front moulding 16, the bores extending through an extension portion 18 of front moulding 16. The front moulding 16 includes a flange portion 19 having parallel ridges 20 on the rear face 21 which also has a recessed portion 22 which extends inwardly from diametric positions of the two rows of bores 17.

It will be evident that the bores 17 are in parallel staggered rows, the pitch corresponding to the conventional pitch of 0.0545 inches (1.39 mm).

The portion 18 is surrounded by a continuous front shell 23 of metal such as cadmium or zinc plated steel.

The relationship between a pin member and a socket member is most clearly seen in FIG. 4 and it will be appreciated that the front moulding 16' terminates at the front face of the corresponding flange 19', so that the pin portions 12' project.

The rear moulding 15 has a hollow interior so that it appears in FIG. 1 as two portions. It has longitudinal sidewalls 24 with inward flanges 25 at their front edges. As shown in FIG. 4, when the parts are assembled, the ends of the flanges 25 abut corresponding notches 20 of the front moulding so that the rear faces of the notches and flanges are aligned in a plane. Locating limbs 26 project inwardly from the sidewalls in staggered rows as best seen in FIGS. 5 and 6. There is a clearance space 27 between the limbs 26 and the flanges 25. The inward ends of the limbs 26 are enlarged to provide flat faces 28 which are coplanar in each row. The enlarged portions of each limb have oppositely facing slots 29, with the slots of each row lying in a plane, so that the slots between a pair of adjacent limbs defines an opening to receive a termination 13. The slots 29 at a point part way down their length decrease in width to form shelves 49,49' (FIG. 6).

Each contactor unit is located with the edges 50,50' of the terminations 13,13' contacting shelves 49,49', the lower limb of the U-shaped bridge portion entering into the clearance space 27. There is a large clearance space 31 between the narrow portions of adjacent limbs for receiving the remainder of the bridging portion 14.

The individual contactor units are best seen in FIGS. 2 and 3. The terminations and bridging portions of the two types of unit are identical. They are each formed of sheet metal such as beryllium copper strip by successive stamping operations. The socket and pin portions 12, 12' are generally conventional, the metal of the pin portion 12' being closed to form the pin and that of the socket 12 being divided into opposed generally hemicylindrical parts which can be bent towards each other near the front end to firmly grip the pins. As shown more particularly in FIG. 4 the rearward end of the contacting portion in each case is enlarged and fits within an enlargement in the bores of the front moulding. There is a projecting tab 32, 32' which lies within the recessed rear face portion 22 of the front moulding. The terminations 13,13' are each composed of a tab having a central slot 33, 33' which opens into a notch 34, 34'. Each has a projecting flange 35, 35' on each side which enters the appropriate slot 29, within which the tabs are frictionally held by protrusions 36, 36', with the shoulders 50,50' contacting the shelves 49,49'.

Each bridging portion 14, 14' comprises a lower limb 37, 37' which is connected to the contacting portion through a connecting piece 38, 38' which is slightly offset from the diameter through the tab 32.

The bridging portion also has an upper limb 39, 39' which connects with the lower limb 37, 37' via a web, 40,40' and with the termination via a connecting piece 41,41', which is off-centre and aligned, as viewed from the tabs 32,32' with the connecting portion 38, 38'.

It can clearly be seen that the bridge portion forms a flat strip of metal which is in a plane as formed but which is easy to flex about the web 40,40' so that the terminations can be flexibly moved generally into and out of alignment with the contacting portions. The terminations 13,13' are set back in the direction of the webs 40,40' from the coupling axis X of the contacting portions.

Returning to FIG. 1 and FIGS. 4 to 6, it will be seen that the locating slots for the terminations are out of alignment with the contacting portions and arranged at a pitch which corresponds to the conventional pitch for ribbon cable. They are so arranged within the connector members that the discrepancy in alignment of each termination with its corresponding contacting portion is smallest towards the middle of the connector member and greatest at each end. Due to the flexibility of the bridge portions a considerable degree of misalignment can be tolerated as shown more particularly in FIG. 5.

The shape of the limbs 26 and clearance spaces are designed to allow entrance of the bridge portions with the lower limbs 37,37' in the clearance spaces 27,27' and the webs and upper limbs within the clearance spaces 31,31'. Although FIGS. 4 and 6 show contact between lower limbs 37,37' and flange 25, clearance is preferably provided.

To complete the connector member an insert moulding 42 is engaged within the central space in the rear moulding 15. The insert moulding has opposed rear sidewall portions 43 which engage with the inward faces 28 of the locating limbs, and inwardly recessed front sidewall portions 44 which, as shown more particularly in FIG. 4, afford clearance for parts of the connecting portions 38,38' of the contactor units. Optionally the insert moulding 42 may have a central longitudinal recess 45 to assist moulding. It will be appreciated that when the inset moulding, rear moulding and front mouldings are connected together, the contactor units are firmly held in place against movement in any direction.

The projecting terminations 13,13' may be protected by a cover moulding 46 provided with longitudinal slots 47 to receive the terminations. The front face of the cover moulding 46 may have ridges shown at 48,48' in FIG. 4 to enter recesses between the strands of the ribbon cable to assist in clamping this in place.

A rear shell 49 extends around the rear moulding 15 and the flange of the front moulding 16. The two shells 23 and 49 may be held together by a conventional eyeletting operation and the ribbed cover moulding may be held in place by metal clips, one at each end, which pass through appropriate slots at the ends of the housing within the shells. Since the terminations are arranged in staggered rows conforming to the pitch of conventional ribbon cable, the cable may be attached without division of the strands or pre-stripping, in a single attaching operation by pressing the cable downwardly by means of the ribbed cover onto the notched terminations 13 so that the individual insulation portions are cut by the notches 34,34' and the conductors are forced into and clamped within individual slots 33,33'. The ribbon cable then extends outwardly at right angles to the length of the connector member where it is clamped in place by the cover moulding 46,46'.

I claim:

1. A contactor unit for an electrical connector, comprising a contactor portion having a coupling axis, a termination, and a flexible bridge portion joining said contactor portion and termination including a web having ends spaced along an axis generally parallel to and laterally spaced from said coupling axis, a first limb extending between and joined to said contactor portion and one end of said limb and a second arm extending between and joined to said termination and the other end of said web, and said bridge portion being flexible about said web to permit relative deflection of said contactor portion and termination laterally of said coupling axis.

2. A connector member comprising:

an elongate housing having front and rear sides and at least one longitudinal row of contactor units mounted in the housing, each contactor unit including a contactor portion at the front side of said housing and a termination at the rear side of said housing, said housing including front and rear longitudinal portions, said front housing portion containing a longitudinal row of openings receiving said contactor portions, respectively, of each row of contactor units, said rear housing portion including a longitudinal side wall adjacent and laterally offset from each row of openings, and each side wall having a longitudinal flange and locating ribs projecting from said flange toward the adjacent opening row, said ribs of each housing side wall being spaced from one another longitudinally of said housing and being spaced rearwardly of said housing from the respective side wall flange, and the adjacent ribs of each side wall having slots aligned lengthwise of said housing and opening toward one another for receiving said contactor unit terminations, respectively, with the bridge portions of the contactor units located between the adjacent ribs, and the adjacent contactor portions and adjacent terminations of each row of contactor units having differing spacings longitudinally of said housing.

3. A connector member according to claim 2 wherein:

said front housing portion has a rear face seating said flange of each housing side wall and a longitudinal shoulder against which each flange abuts.

4. A connector member according to claim 2 including:

an elongate insert member having a side face engaging said ribs of each housing side wall, and a recessed portion inset relative to said side face to afford clearance for portions of the respective contactor units.

5. A contactor unit for an electrical connector comprising a front contactor portion having a coupling axis, a rear termination laterally offset from said axis, a flexible bridge portion joining said contactor portion and termination and extending laterally outward from said contactor portion a distance past said termination and then back to said termination, and said bridge portion being flexible to permit relative movement of said contactor portion and termination laterally of said coupling axis.

6. The contactor unit according to claim 5 wherein said bridge portion is generally U-shaped and has an outer end beyond said termination.

7. The contactor unit according to claim 5 wherein said bridge portion in its normal unstressed condition is generally flat and disposed in a plane containing said coupling axis.

8. The contactor unit according to claim 7 wherein said termination is a generally planar element substantially normal to said plane and having a conductor receiving slot.

9. A connector member, comprising:

a housing, a contactor unit in said housing including a front contactor portion having a coupling axis, a rear termination laterally offset from said axis, a flexible bridge portion joining said contactor portion and termination and extending laterally outward from said contactor portion a distance past said termination and them back to said termination, and said bridge portion being flexible to permit relative displacement of said contactor portion and termination laterally of said coupling axis, said housing having front and rear sides, an opening receiving said contactor portion of said contactor unit, said opening having a front end opening thru said front housing side and a rear end, spaced confronting walls adjacent and laterally offset from the rear end of said opening and containing slots receiving said termination, and said walls defining therebetween a space extending laterally of said opening and outwardly beyond said slots for receiving said bridge portion with the latter extending outwardly thru said space to a position beyond said slots, and said space being sized in width between said walls to accommodate deflection of said bridge portion sufficiently to permit alignment of said contactor portion and termination with said opening and wall slots, respectively, and thereby enable insertion of said connector unit into said housing.

10. The connector member according to claim 9 wherein said bridge portion is generally U-shaped and has an outer extremity beyond said termination.

11. The connector member according to claim 10 wherein said bridge portion has front and rear limbs relative to said housing disposed within the front and rear portions, respectively, of said space and joined to and extending laterally outward from said front contactor portion and rear termination, respectively, said wall slots are located in the rear portion of said space and said front portion of said space is wider than the rear portion of said space to accommodate sufficient relative lateral deflection of said limbs to permit insertion of said contactor unit into said housing.

12. The connector member according to claim 11 wherein said termination is a relatively flat plate in a plane transverse to said rear bridge portion limb and having its edges disposed in said wall slots.

13. A connector member comprising:

a housing, at least one row of contactor units in said housing, each contactor unit including a front contactor portion housing a coupling axis, a rear termination laterally offset from said axis, a flexible bridge portion joining said contactor portion and termination and extending laterally outward from said contactor portion a distance past said termination and them back to said termination, and said bridge portion being flexible to permit relative displacement of said contactor portion and termination laterally of said coupling axis, said housing having front and rear sides, a row of openings receiving said contactor portions, respectively, of said contactor units, each opening having a front end opening thru said front housing said and a rear end, spaced confronting walls adjacent and laterally offset from the rear end of each opening and containing slots receiving said termination of the respective contactor unit, and said walls defining therebetween a space extending laterally of the respective opening and outwardly beyond the respective slots for receiving said bridge portion of the respective contactor unit with the bridge portion extending outwardly thru the space to a position beyond said slots, and each said space being sized in width to accommodate deflection of the bridge portion of the respective contactor unit sufficiently to permit alignment of its contactor portion and termination with the respective opening and wall slots and thereby enable insertion of the contactor unit into said housing.

14. The connector member according to claim 13 wherein said bridge portion of each contactor unit is generally U-shaped and has an outer extremity beyond the respective termination.

15. The connector member according to claim 14 wherein said bridge portion of each contactor unit has front and rear limbs relative to said housing disposed within the front and rear portions, respectively, of the corresponding space and joined to and extending laterally outward from said front contactor portion and rear termination, respectively, of the contactor unit, said wall slots for each termination are located in the rear portion of the respective space, and said front portion of the space is wider than the rear portion of the space to accommodate sufficient lateral deflection of said limbs to insert each connector unit into said housing.

16. The connector member of claim 15 wherein said spaces and openings have different spacings lengthwise of said row.

17. The connector member of claim 13 wherein said spaces and openings have different spacings lengthwise of said row.

* * * * *